US011696612B2

(12) United States Patent
Leon

(10) Patent No.: US 11,696,612 B2
(45) **Date of Patent: *Jul. 11, 2023**

(54) HELMET

(71) Applicant: Lionhead Helmet Intellectual Properties, LP, Ambler, PA (US)

(72) Inventor: Robert L. Leon, Ambler, PA (US)

(73) Assignee: LIONHEAD HELMET INTELLECTUAL PROPERTIES, LP, Ambler, PA (US)

( * ) Notice: Subject to any disclaimer, the term of this patent is extended or adjusted under 35 U.S.C. 154(b) by 303 days.

This patent is subject to a terminal disclaimer.

(21) Appl. No.: 17/091,168

(22) Filed: Nov. 6, 2020

(65) Prior Publication Data

US 2021/0137201 A1 May 13, 2021

Related U.S. Application Data

(63) Continuation of application No. 16/677,073, filed on Nov. 7, 2019, now Pat. No. 10,869,520.

(51) Int. Cl.

| | |
|---|---|
| ***A42B 3/12*** | (2006.01) |
| ***A42B 3/06*** | (2006.01) |
| ***A42B 3/00*** | (2006.01) |

(52) U.S. Cl.

CPC ..... *A42B 3/125* (2013.01); *A42B 3/003* (2013.01); *A42B 3/063* (2013.01)

(58) Field of Classification Search

CPC ..... A42B 3/125; A42B 3/003; A42B 3/063; A42B 3/128

See application file for complete search history.

(56) References Cited

U.S. PATENT DOCUMENTS

| | | | |
|---|---|---|---|
| 2,835,313 | A | 5/1958 | Dodge |
| 3,425,061 | A | 2/1969 | Webb |

(Continued)

FOREIGN PATENT DOCUMENTS

| | | | |
|---|---|---|---|
| CN | 101850638 | A | 10/2010 |
| DE | 4226588 | A1 | 2/1994 |

(Continued)

OTHER PUBLICATIONS

Int'l Report on Patentability dated May 10, 2022 in Int'l Application No. PCT/US2020/059409.

(Continued)

*Primary Examiner* — Tajash D Patel
(74) *Attorney, Agent, or Firm* — Panitch Schwarze Belisario & Nadel LLP

(57) ABSTRACT

A helmet to be worn on a head having an annular headband shaped area. The headband shaped area positioned near an upper junction of the ears and the wearer's head. A top area is centered about a top of the wearer's head. A middle area defined between the headband area and the top area. The helmet includes a shell having an inner surface. A first type of subliner elements extend from the inner surface at a location such that the first type of subliner elements are aligned with the headband area. A second type of subliner elements extend from the inner surface at a location such that the second type of subliner elements are aligned with the middle area. A third type of subliner element extends from the inner surface at a location such that the third type of subliner element is aligned with the top area.

19 Claims, 10 Drawing Sheets

(56) References Cited

U.S. PATENT DOCUMENTS 3,577,562 A 5/1971 Holt
3,877,076 A 4/1975 Summers et al.
3,931,606 A 1/1976 Oka et al.
3,943,572 A 3/1976 Aileo
4,290,149 A 9/1981 Aileo
4,307,471 A 12/1981 Lovell
4,345,338 A 8/1982 Frieder, Jr. et al.
4,534,068 A 8/1985 Mitchell et al.
4,586,200 A 5/1986 Poon
5,030,501 A 7/1991 Colvin et al.
5,204,998 A 4/1993 Liu et al.
5,589,016 A 12/1996 Hoopingarner et al.
5,713,082 A 2/1998 Bassette et al.
5,815,846 A 10/1998 Calonge
5,956,777 A 9/1999 Popovich
5,970,550 A 10/1999 Gazes
6,070,271 A 6/2000 Williams
6,070,905 A 6/2000 Renault
6,219,850 B1 4/2001 Halstead et al.
6,298,497 B1 10/2001 Chartrand
6,308,490 B1 10/2001 Saebi
6,324,700 B1 12/2001 McDougall
6,453,476 B1 9/2002 Moore, III
6,658,671 B1 12/2003 Von Holst et al.
6,871,525 B2 3/2005 Withnall et al.
6,934,971 B2 8/2005 Ide et al.
6,968,575 B2 11/2005 Durocher
7,240,376 B2 7/2007 Ide et al.
7,367,898 B2 5/2008 Hawkins et al.
7,461,726 B2 12/2008 Hawkins et al.
7,603,725 B2 10/2009 Harris
7,676,854 B2 3/2010 Berger et al.
7,774,866 B2 8/2010 Ferrara
7,802,320 B2 9/2010 Morgan
7,832,023 B2 11/2010 Crisco
7,900,279 B2 3/2011 Kraemer et al.
7,930,771 B2 4/2011 Depreitere et al.
7,954,177 B2 6/2011 Ide et al.
7,954,178 B2 6/2011 Durocher et al.
8,015,624 B2 9/2011 Baldackin et al.
8,127,373 B1 3/2012 Fodemski
8,166,574 B2 5/2012 Hassler
8,191,179 B2 6/2012 Durocher et al.
8,196,226 B1 6/2012 Schuh
8,347,421 B2 1/2013 Krueger
8,365,315 B2 2/2013 Ortiz et al.
8,387,164 B2 3/2013 Maddux et al.
8,402,715 B2 3/2013 Uhllg et al.
8,578,520 B2 11/2013 Halldin
8,640,267 B1 2/2014 Cohen
8,955,169 B2 2/2015 Weber et al.
9,032,558 B2 5/2015 Leon
9,578,917 B2 2/2017 Cohen
9,975,032 B2 5/2018 Frey
10,869,520 B1 12/2020 Leon
11,547,166 B1 1/2023 Leon
2001/0031350 A1 10/2001 Day et al.
2002/0023291 A1 2/2002 Mendoza
2002/0056521 A1 5/2002 Chen et al.
2003/0140400 A1 7/2003 Ho
2004/0117896 A1 6/2004 Madey et al.
2004/0250340 A1 12/2004 Piper et al.
2005/0246824 A1 11/2005 Berger et al.
2006/0031978 A1 2/2006 Pierce
2006/0059606 A1 3/2006 Ferrara
2006/0070170 A1 4/2006 Copeland et al.
2006/0112477 A1 6/2006 Schneider
2007/0068755 A1 3/2007 Hawkins et al.
2008/0066217 A1 3/2008 Depreitere et al.
2008/0120764 A1 5/2008 Sajic
2008/0155735 A1 7/2008 Ferrara
2008/0256685 A1 10/2008 Lampe et al.
2009/0000377 A1 1/2009 Shipps et al.
2009/0024406 A1 1/2009 Rawls-Meehan
2009/0151056 A1 6/2009 Desjardins et al.
2009/0218185 A1 9/2009 Lin
2009/0265839 A1 10/2009 Young et al.
2009/0320185 A1 12/2009 Hassler
2010/0005573 A1 1/2010 Rudd et al.
2010/0299812 A1 12/2010 Maddux et al.
2010/0319109 A1 12/2010 Field
2011/0072587 A1 3/2011 Cao et al.
2011/0107503 A1 5/2011 Morgan
2011/0117310 A1 5/2011 Anderson et al.
2011/0131695 A1 6/2011 Maddux et al.
2011/0171420 A1 7/2011 Yang
2011/0252544 A1 10/2011 Abernethy
2011/0271427 A1 11/2011 Milsom
2011/0277221 A1 11/2011 Ide et al.
2012/0047635 A1 3/2012 Finiel et al.
2012/0096631 A1 4/2012 King et al.
2012/0143526 A1 6/2012 Benzel et al.
2012/0151663 A1 6/2012 Rumbaugh
2012/0151664 A1 6/2012 Kirshon
2012/0186002 A1 7/2012 Bhatnagar et al.
2012/0186003 A1 7/2012 Heger et al.
2012/0192337 A1 8/2012 Divine et al.
2012/0198604 A1 8/2012 Weber et al.
2012/0198605 A1 8/2012 Maddux et al.
2012/0204329 A1 8/2012 Faden et al.
2012/0207964 A1 8/2012 Faden et al.
2012/0208032 A1 8/2012 Faden et al.
2012/0216339 A1 8/2012 Nimmons et al.
2012/0233745 A1 9/2012 Veazie
2012/0266365 A1 10/2012 Cohen
2012/0266366 A1 10/2012 Ferrara
2012/0297525 A1 11/2012 Bain
2012/0304366 A1 12/2012 Daoust
2012/0304367 A1 12/2012 Howard et al.
2012/0317705 A1 12/2012 Lindsay
2012/0324634 A1 12/2012 Coyle
2013/0000016 A1 1/2013 Hall et al.
2013/0000017 A1 1/2013 Szalkowski et al.
2013/0000018 A1 1/2013 Rudd et al.
2013/0007950 A1 1/2013 Arai
2013/0019384 A1 1/2013 Knight
2013/0019385 A1 1/2013 Knight
2013/0025031 A1 1/2013 Laperriere et al.
2013/0025032 A1 1/2013 Durocher et al.
2013/0025033 A1 1/2013 Durocher et al.
2013/0036531 A1 2/2013 Belanger et al.
2013/0040524 A1 2/2013 Halldin et al.
2013/0042397 A1 2/2013 Halldin
2013/0055488 A1 3/2013 Garneau
2013/0061371 A1 3/2013 Phipps et al.
2013/0061372 A1 3/2013 Goldstein
2013/0061375 A1 3/2013 Bologna et al.
2013/0111654 A1 5/2013 Gorsen et al.
2013/0122256 A1 5/2013 Kleiven et al.
2013/0185837 A1 7/2013 Phipps et al.
2013/0254978 A1 10/2013 McInnis et al.
2013/0291289 A1 11/2013 Szalkowski et al.
2013/0340147 A1 12/2013 Giles
2014/0013492 A1 1/2014 Bottlang et al.
2014/0020158 A1 1/2014 Parsons et al.
2014/0096311 A1 4/2014 Halldin
2014/0170372 A1 6/2014 Fink
2014/0196198 A1 7/2014 Cohen
2014/0196998 A1 7/2014 Nauman et al.
2015/0000018 A1 1/2015 Brandt
2015/0223546 A1 8/2015 Cohen
2016/0021965 A1* 1/2016 Mayerovitch ..... A42B 3/064 2/414
2017/0065018 A1 3/2017 Lindsay
2018/0249778 A1 9/2018 Brandt et al.
2019/0029352 A1 1/2019 Sadegh et al.

FOREIGN PATENT DOCUMENTS

EP 1142495 A1 10/2001
GB 2530309 A * 3/2016 ..... A41D 31/005

(56) References Cited

FOREIGN PATENT DOCUMENTS

WO 2004032659 A1 4/2004
WO WO-2020236930 A1 * 11/2020 ..... A42B 3/124

OTHER PUBLICATIONS

Rowson et al., "Linear and Angular Head Acceleration Measurements in Collegiate Football," Journal of Biomechanical Engineering, Vo. 131, 7 pages (Jun. 2009).
Broglio et al., "Biomechanical Properties of Concussions in High School Football," Medicine and Science in Sports Exercise; www.medscape.com, pp. 1-10, (Nov. 23, 2010).
Greenwald et al., "Head Impact Telemetry System (HITSTM) for Measurement of Head Acceleration in the Field," American Society of Biomechanics—2003 Annual Meeting, 2 pages.
Daniel et al., "Head Impact Exposure in Youth Football," Annals of Biomedical Engineering, 6 pages (Feb. 15, 2012).
ASTM F 1446-04, "Standard Test Methods for Equipment and Procedures Used in Evaluating the Performance Characteristics of Protective Hedgear," ASTM International, pp. 1-11 (date: unknown).
"Head Injuries in Football," The New York Times, pp. 4 (Nov. 16, 2011).
Rousseau et al., "A Comparison of Peak Linear and Angular Headform Accelerations Using Ice Hockey Helmets," Journal of ASTM International; www.astm.org, vol. 6, No. 1, 11 pages (Feb. 20, 2009).
Rowson et al., "Development for the STAR Evaluation System for Football Helmets: Integrating Player Head Impact Exposure and Risk of Concussion," Annals of Biomedical Engineering, 11 pages (May 7, 2011).
Rousseau et al., "The Influence of Deflection and Neck Compliance on the Impact Dynamics of a Hybrid III Headform," Proceedings of the Institution of Mechanical Engineers, vol. 223, Part P: J. Sports Engineering and Technology, pp. 89-97 (Apr. 3, 2009).
"2011 Concussion Report—End of Regular Season," 4 pages (Jan. 10, 2012).
Shipley, "Traumatic Brain Injury and Diffuse Axonal Injury," Trial Image Inc.; www.trialimagestore.com, pp. 1-5 (Feb. 18, 2011).
Newman et al., "A New Biomechanical Assessment of Mild Traumatic Brain Injury Part 2—Results and Conclusions," 11 pages, (date: unknown).
King et al., "Is Head Injury Caused by Linear or Angular Acceleration? ," IRCOBI Conference, pp. 1-12 (Sep. 2003).
Nocsae Doc (ND) 001-11M11, "Standard Test Method and Equipment Used in Evaluating the Performance Characteristics of Protective Headgear Equipment," NOCSAE/National Operating Committee on Standards for Athletic Equipment, pp. 1-25 (Jan. 2012).
Nocsae Doc (ND) 002-11m11a, "Standard Performance Specification for Newly Manufactured Football Helmets," NOCSAE/National Operating Committee on Standards for Athletic Equipment, pp. 1-6 (Feb. 2012).
"NOCSAE receives $1.1M Research Grants to Advance Science of Sports Medicine," 2 pages (Jun. 20, 2011).
"Helmet Safety Group Approves Research Grants," SFGate.com, 1 page (Jun. 18, 2011).
Bartholet, "The Collision Syndrome," Scientific American, pp. 68-71 (Feb. 2012).
Kluger, "Headbanger Nation. Concussions are clobbering U.S. kids. Here's why," Time Magazine, pp. 42-51 (Jan. 31, 2011).
"Concussion," Wikipedia, 17 pages (page last modified on May 21, 2012).
Int'l Search Report dated Aug. 8, 2012 in Int'l Application No. PCT/US12/38337; Written Opinion.
Int'l Preliminary Report on Patentability dated Aug. 13, 2013 in Int'l Application No. PCT/US2012/038337.
Office Action dated Aug. 14, 2013 in U.S. Appl. No. 13/471,962.
Office Action dated Aug. 14, 2013 in U.S. Appl. No. 13/868,699.
Office Action dated Dec. 13, 2013 in U.S. Appl. No. 13/868,699.
Office Action dated Dec. 11, 2013 in U.S. Appl. No. 13/471,962.
Office Action dated May 27, 2014 in U.S. Appl. No. 13/471,962.
Extended European Search Report dated Jun. 23, 2015 in EP Application No. 12789200.8.
Office Action dated Aug. 10, 2015 in U.S. Appl. No. 14/709,959 by LEON.
"Frustoconical," Wiktionary, N.p., n.d. Web. Aug. 4, 2015.
"Frustum." Wiktionary. N.p., n.d. Web. Aug. 4, 2015.
Office Action dated Nov. 19, 2015 in U.S. Appl. No. 14/709,959 by LEON.
Office Action dated Nov. 17, 2015 in U.S. Appl. No. 14/809,439 by LEON.
Office Action dated Oct. 22, 2015 in U.S. Appl. No. 14/809,561 in LEON.
Office Action dated Dec. 16, 2015 in U.S. Appl. No. 14/921,582 by LEON.
Office Action dated Jan. 15, 2016 in U.S. Appl. No. 14/922,982 by LEON.
Office Action dated Mar. 11, 2016 in U.S. Appl. No. 14/809,439 by LEON.
"EZ Dri." INOAC. INOAC, n.d. Web Mar. 2, 2016.
"Outdoor Foam Cushion, Waterproof Foam, Patio Cushion, Furniture Cushions." Outdoor Foam Cushion, Waterproof Foam, Patio Cushion, Furniture Cushions. N.p., n d. Web Mar. 2, 2016.
Office Action dated Jun. 27, 2016 in U.S. Appl. No. 14/709,959, by LEON.
"Reticulated Polyurethane Foam", Producer of Custom-Engineered Components, Products & Packaging, 4 pages (Oct. 2016).
Office Action dated Oct. 27, 2016 in U.S. Appl. No. 14/709,959, by LEON.
Office Action dated Oct. 20, 2016 in U.S. Appl. No. 14/809,439, by LEON.
Office Action dated Feb. 9, 2017 in EP Application No. 12789200.8.
Office Action dated Sep. 6, 2017 in EP Application No. 12789200.8.
Qi, HJ and Boyce, MC, Stress-strain Behavior of Thermoplastic Polyurethane. Submitted to Mechanics of Materials. Submitted Dec. 2003, Revised Jul. 2004.
Orringer, et al., Crash Padding Research, vol. 1, Material Mechanical Properties, Final Report, Accessed through the National Academies of Sciences, Engineering Medicine, 1986-87.

* cited by examiner

HELMET

CROSS REFERENCE TO RELATED APPLICATION

This application is a continuation of U.S. application Ser. No. 16/677,073, filed Nov. 7, 2019, the disclosure of which is incorporated herein by reference.

BACKGROUND OF THE DISCLOSURE

The present disclosure generally relates to a helmet whose purpose is to protect a wearer's head during a head impact. Extending radially outward from the wearer's head, the helmet may consist of one or multiple liner portions and one or multiple shell portions. Either way, there is typically a liner portion in contact with the wearer's head initially or during impact, that liner portion being herein defined as the subliner. The subliner may be comprised of individual subliner elements. The subliner is typically attached to an inner shell portion, the term inner having been added to unambiguously differentiate it from an outer shell portion in the case of a helmet with multiple shell portions. In helmets having just a single liner portion and a single shell portion, the liner portion would be the same as the subliner and the shell portion would be the same as the inner shell portion. In some helmets (typically hockey helmets) the inner shell portion may consist of individual shell segments. The subliner and inner shell portion together are herein defined as the helmet subliner system, and the present disclosure comprises an improved helmet subliner system to better protect the wearer from sustaining concussions and other head injuries.

Especially in multiple liner, multiple shell helmets, the subliner, as defined herein has been used primarily for obtaining the best fit and best comfort for the wearer. But as will be shown in this specification, the subliner, and more generally the subliner system may also be used to substantially improve the head protection performance of the helmet. The disclosure recognizes and takes advantage of the fact that all of the forces that are applied to the wearer's head during a head impact are preferably applied through the subliner and its elements.

Recent postmortem brain investigations have found a high instance of chronic traumatic encephalopathy, or CTE, in the donated brains of deceased NFL football players, many of whom had suffered debilitating symptoms during their lifetimes, including unexplained rage, extreme mood swings, and substantial cognitive degeneration, all of which may have begun years after their football playing ended. Current research shows that CTE can almost always be traced back to long term repetitive head impacts which may include both concussive and sub-concussive impacts. It is believed those impacts would have been characterized by a high level of head angular acceleration, sometimes called rotational acceleration. The improved helmet subliner system configuration of the present disclosure, is specifically designed to help reduce the level of head angular acceleration during a head impact.

SUMMARY OF THE INVENTION

Briefly stated, the present disclosure is directed to a helmet to be worn on a head of a wearer. The head has a pair of eyebrows, a pair of ears, and an annular headband shaped area encircling the wearer's head. The headband shaped area being approximately 0.75 to 1.25 inches wide and having a lower edge defining a plane positioned approximately 0.5 to 1.5 inches above the eyebrows and approximately 0.25 to 0.75 inches above an upper junction of the ears and the wearer's head. A top area is centered about a top of the wearer's head and encompasses from 0.44 to 7 square inches. A middle area of the head is defined between the headband area and the top area. The helmet includes a shell comprised of a hard impact resistant material and having inner and outer surfaces. The shell is adapted to surround at least a portion of the cranial part of wearer's head with the inner surface of the shell being spaced from the wearer's head at an initial pre-impact relative position when the helmet is worn. A subliner, at least a part of which is in potential contact with the wearer's head when the helmet is worn prior to an impact and during an impact, includes a plurality of a first type of subliner elements extending from the inner surface of the shell at a location such that the first type of subliner elements are aligned with the headband area when the helmet is worn. The first type of subliner elements are constructed of an energy absorbing viscoelastic foam material capable of exhibiting a compressive stress of at least 50 psi for a dynamic compression of 50%. A plurality of a second type of subliner elements extend from the inner surface of the shell at a location such that the second type of subliner elements are aligned with the middle area when the helmet is worn. The second type of subliner element being constructed of a foam material that can exhibit a compressive stress of less than 10 psi for a static and a dynamic compression of 50%. A third type of subliner element extends from the inner surface of the shell at a location such that the third type of subliner element is aligned with the top area when the helmet is worn. The third type of subliner element is comprised of an energy absorbing viscoelastic foam material capable of exhibiting a compressive stress of at least 50 psi for a dynamic compression of 50%. The third type of subliner element has a substantially flat lower surface which is substantially tangent to the surface of the wearer's head beneath it when the helmet is worn.

In another aspect, the present disclosure is directed to a helmet to be worn on a head of a wearer. The head has a pair of eyebrows, a pair of ears, and an annular headband shaped area encircling the wearer's head. The headband shaped area being approximately 0.75 to 1.25 inches wide and having a lower edge defining a plane positioned approximately 0.5 to 1.5 inches above the eyebrows and approximately 0.25 to 0.75 inches above an upper junction of the ears and the wearer's head. A top area is centered about a top of the wearer's head and encompasses from 0.44 to 7 square inches. A middle area of the head is defined between the headband area and the top area. The helmet includes an inner shell comprised of a hard high strength material and having inner and outer surfaces. The shell is adapted to surround at least a portion of the cranial part of wearer's head with the inner surface of the shell being spaced from the wearer's head at an initial pre-impact relative position when the helmet is worn. A subliner, at least a part of which is in potential contact with the wearer's head when the helmet is worn prior to an impact and during an impact, includes a plurality of a first type of subliner elements extending from the inner surface of the shell at a location such that the first type of subliner elements are aligned with the headband area when the helmet is worn. The first type of subliner elements are constructed of an energy absorbing viscoelastic foam material capable of exhibiting a compressive stress of at least 50 psi for a dynamic compression of 50%. A plurality of a second type of subliner elements extend from the inner surface of the shell at a location such that the second type of subliner elements are aligned with the middle area when the helmet is worn. The second type of subliner element being constructed of a foam material that can exhibit a compressive stress of less than 10 psi for a static and a dynamic compression of 50%. A third type of subliner element extends from the inner surface of the shell at a location such that the third type of subliner element is aligned with the top area when the helmet is worn. The third type of subliner element is comprised of an energy absorbing viscoelastic foam material capable of exhibiting a compressive stress of at least 50 psi for a dynamic compression of 50%. The third type of subliner element has a substantially flat lower surface which is substantially tangent to the surface of the wearer's head beneath it when the helmet is worn. An outer shell comprised of a hard impact resistant material having inner and outer surfaces surrounds at least a portion of the inner shell. The inner surface of the outer shell being spaced from the outer surface of the inner shell at an initial pre-impact relative position. A plurality of outer liner elements is located in the space between the outer surface of the inner shell and the inner surface of the outer shell.

BRIEF DESCRIPTION OF THE DRAWINGS

The foregoing summary, as well as the following detailed analysis of the physical principles and detailed descriptions of the preferred embodiments will be better understood when read in conjunction with the appended drawings. For the purpose of illustrating the disclosure, particular arrangements and methodologies of preferred embodiments are shown in the drawings. It should be understood, however, that the disclosure is not limited to the precise arrangements or instrumentalities shown or the methodologies of the detailed description. In the drawings.

DETAILED DESCRIPTION OF THE INVENTION

Figure 1:
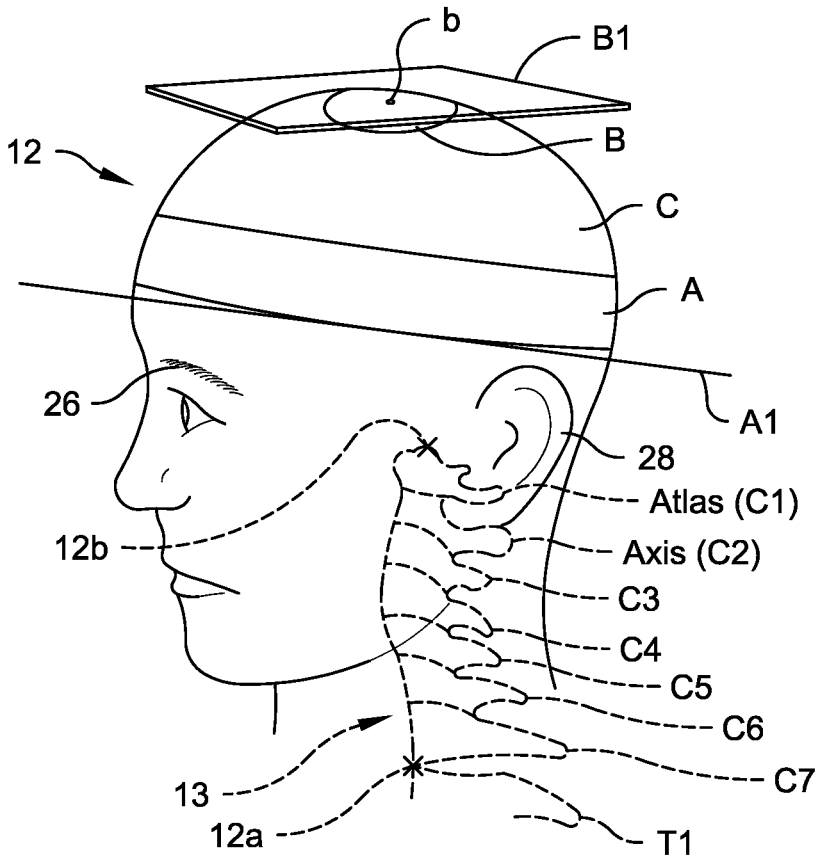
FIG. 1 is a perspective side view of a wearer's head with defined areas, planes, and points in accordance with the present disclosure.

Certain terminology is used in the following description for convenience only and is not limiting. The words "lower," "bottom," "upper" and "top" designate directions in the drawings to which reference is made. The words "inwardly," "outwardly," "upwardly" and "downwardly" refer to directions toward and away from, respectively, the geometric center of the helmet, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import. The terms "angular acceleration" and "rotational acceleration" should be taken as synonymous from a force vector perspective. Similarly, the words "acceleration" and "deceleration" should also be taken as synonymous from a force vector perspective.

It should also be understood that the terms "about," "approximately," "generally," "substantially" and like terms, used herein when referring to a dimension or characteristic of a component of the disclosure, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Figure 2:
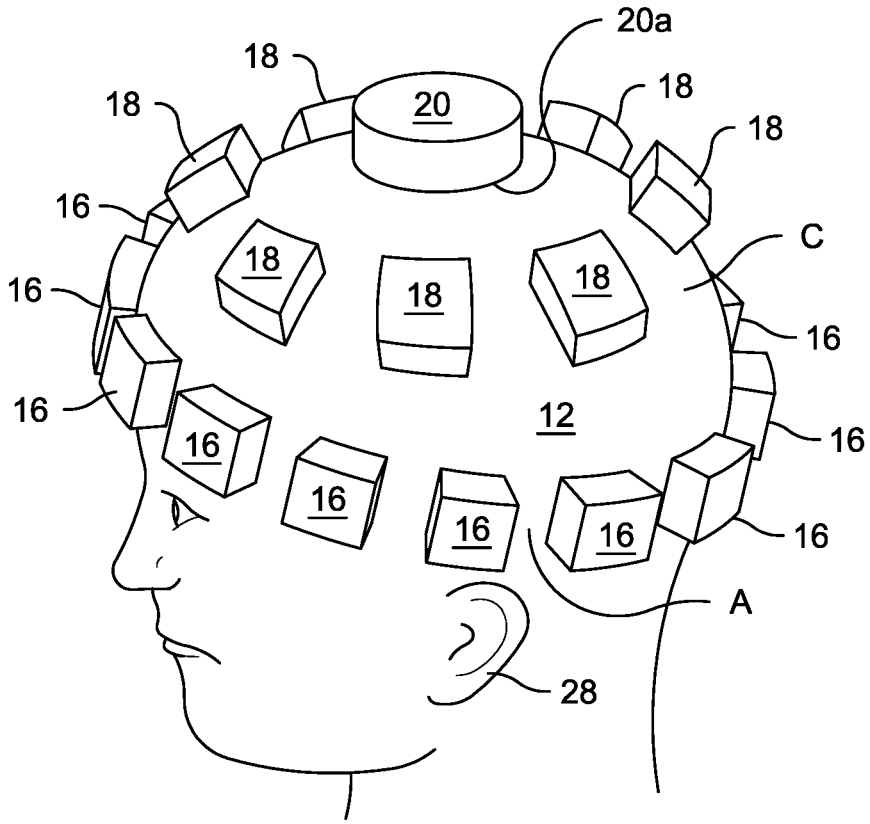
FIG. 2 is a perspective upper side view of a wearer's head showing the three types of subliner elements as they would be located in their respective designated areas, in accordance with the present disclosure.
Figure 4:
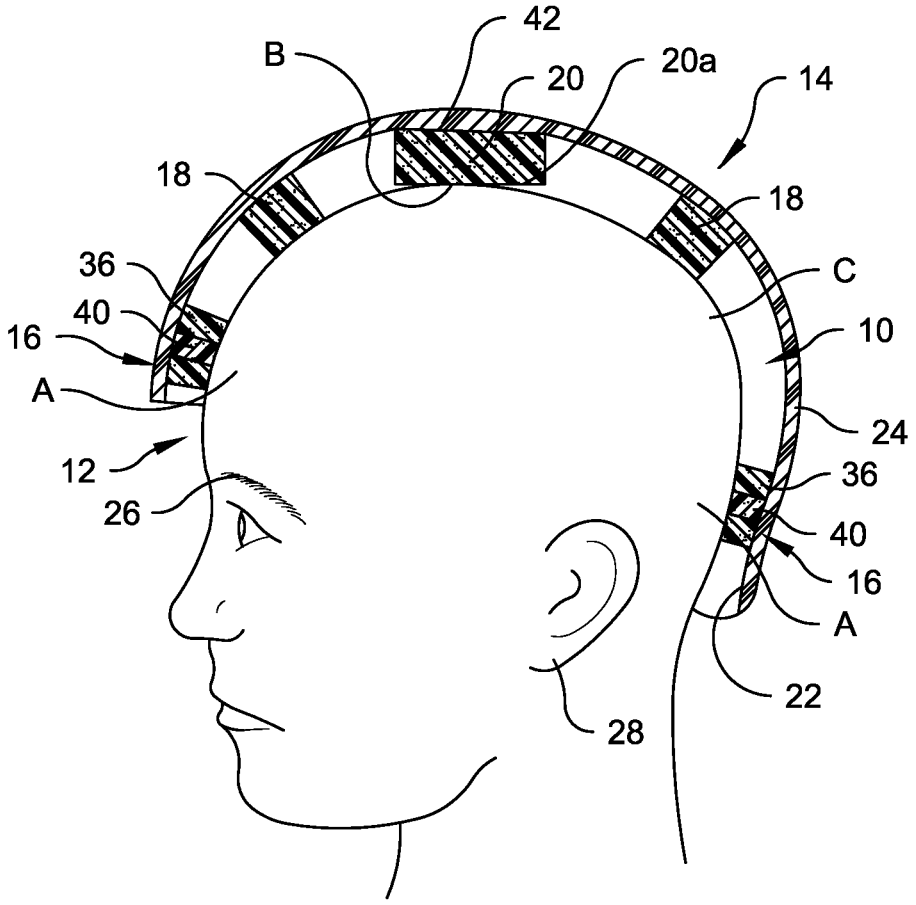
FIG. 4 is cross-sectional side view at the midsagittal plane of a wearer's head, showing the subliner elements of FIG. 2 and the inner shell to which they are attached forming a subliner system in accordance with the present disclosure.

Referring now to FIGS. 1, 2 and 4, to best understand the configuration of the helmet subliner system or subliner 10, which is the subject of this disclosure, it will be useful to first define certain areas of a potential wearer's head 12 which could come in contact with various types of subliner elements of the helmet 14. In this regard, all the following will be defined: first area A, first plane μl, second plane B1, point b, second area B, and third area C.

FIG. 1 is a perspective side view of a wearer's head 12 having a pair of eyebrows 26 (only one is shown) and a pair of ears 28 (only one is shown). The head 12 includes a first area A, first plane μl, second plane B1, point b, second area B, and third area C. First area A is an annular headband shaped area encircling the wearer's head 12. The first or headband shaped area A being approximately 0.75 to 1.25 inches wide, and preferably approximately 1.0 inch wide, and having a lower edge defining a plane positioned approximately 0.5 to 1.5 inches, and preferably approximately 1.0 inch, above the eyebrows 26 and approximately 0.25 to 0.75 inches, and preferably approximately 0.5 inches, above a location where the ears 28 join the wearer's head 12 at the top or, stated differently, an upper junction of the ears 28 and the wearer's head 12. The first plane μl is a hypothetical plane defined by the lower edge of first area A. Picture second plane B1 as a lower cover of an imaginary hard cover book being balanced horizontally atop the wearer's head 12 while the wearer's head 12 is maintained in an upright position, tilted neither right nor left, nor forward nor backward and where point b is approximately the center of the contact area between the lower cover of the imaginary book and the wearer's head 12. Notice that first plane μl is tilted upward in the forward direction (the direction toward the face of the wearer) relative to second plane B1. In FIG. 1, the second plane B1 is shown as transparent so that the contact area with the wearer's head 12, point b, is apparent. The second or top area B is formed by a planar projection of an approximate 2-inch diameter circle (not shown) formed in the second plane B1 centered about point b onto the wearer's head. That is, the second area B is generally circular and is centered about a top of the wearer's head 12 and extends 0.75 to 3 inches, and preferably 2 inches, in diameter in all lateral directions. As will be discussed, the second area B needn't be 2 inches in diameter, nor even circular. That is, the second area B can range from 0.44 to 7 square inches, or preferably 3.14 square inches. The third or middle area C is the area on the wearer's head 12 between first area A and second area B.

Referring again to FIGS. 1, 2 and 4 and as will be described in detail in subsequent sections of the specification, subliner elements of a first type 16 are to be located in the first area A; subliner elements of a second type 18 are to be utilized in third area C, and a subliner element of a third type 20 is to be used in second area B. Each type of subliner element 16, 18, 20 has its own specific physical characteristics in accordance with the purpose of the disclosure which is to be able to reduce the level of head angular acceleration imparted to a wearer's head 12 during a head impact, regardless of the location or direction of the impact. Each of the subliner elements 16, 18, 20 is to be attached to an inner surface 22 of the inner shell 24 of the helmet 14, preferably utilizing a commonly employed hook and loop type of fastener arrangement which allows for the simple assembly of, and changeout of, individual subliner elements 16, 18, 20 during a fitting process, with each subliner element 16, 18, 20 being positioned and sized in its thickness direction to best fit the size and shape of a wearer's head 12. It will be appreciated by one skilled in the art, that other fastening elements could be used to releasably secure the subliner elements 16, 18, 20 to the inner surface 22 of the inner shell 24 of the helmet 14, such as a releasable adhesive (not shown).

FIG. 2 is a perspective upper side view of a wearer's head 12 showing the first, second and third types of subliner elements 16, 18, 20 as they would be located in their respective designated areas shown in FIG. 1, in accordance with the present disclosure. The individual subliner elements 16, 18, 20 are not attached to the wearer's head 12 (as could be falsely assumed from FIG. 2) but are merely illustrated in the figure where they would be located with respect to the wearer's head 12 when the helmet 14 is worn. Typically, they would be attached to the inner surface 22 of the inner shell 24 of the helmet 14, as shown in FIG. 4, preferably utilizing a commonly employed hook and loop type of fastener arrangement, describe below. The upper side viewpoint enables a fuller view of subliner element of the third type 20, which is preferably disc or oval shaped, oriented generally in the second plane B1, and is centered about point b at the top, or crown, of the head 12. Subliner element of the third type 20 has a flat (or nearly flat), horizontal (or nearly horizontal), lower surface 20*a* which may be either initially in contact with the wearer's head 12 or slightly spaced therefrom but may come into contact with the wearer's head 12 during an impact. Subliner element of the third type 20 is shown here as a circular disc having a two-inch diameter to accommodate any misalignment of the center of the disc with the initial actual point of contact with a wearer's head 12 and to accommodate lateral displacements between the inner shell 24 and the wearer's head 12 during an impact. In general, subliner element of the third type 20 need not be circular, but it may be of any suitable contiguous shape typically having that approximate area or greater. The important thing is that its lower surface 20*a* be of sufficient area to enable the accommodations described above, and that it be predominately flat and horizontal such that it is substantially tangent to the surface of the wearer's head 12 beneath it when the helmet 14 is worn.

To be able to appreciate why the lower surface 20*a* of subliner element of the third type 20 is preferred to be flat and horizontal, one may perform a simple experiment with one's own hand and one's own head. First, using one's hand, firmly cup the top of one's head. Then while still firmly cupping the head, forcefully move the cupping hand's forearm forward and backward, and side to side, and notice how the head is forced into violent motion likely involving significant head angular accelerations. Next, repeat the experiment while the hand is held flat and horizontal. The result: almost no forced motion of the head, and thus no head angular acceleration.

The subliner element of the third type 20 is preferably made of relatively stiff, very energy absorbent, viscoelastic foam material, capable of exhibiting a compressive stress of 20 psi for a static compression of 50% and at least 50 psi for a dynamic impact type compression of 50%, for example a vinyl nitrile foam such as IMPAX® VN600, VN740, or VN1000 by Dertex Corporation, or a polyurethane foam such as LAST-A-FOAM® TF 8015 by General Plastics Manufacturing Company. The subliner element of the third type 20 should be thick enough not to compress all the way to its full densification condition under a peak normal impact force which could easily reach, and possibly even exceed, a thousand pounds. Although the weight of a full helmet would likely be substantially less than that (being typically under five pounds), if all the helmet weight were to be required to be supported by the subliner element of the third type 20, with its high dynamic stiffness designed to accommodate a dynamic force of over a thousand pounds, the supporting area around point b for a static force of just five pounds could be so small that the supporting pressure could be uncomfortably high for the wearer were it not for the subliner elements of the second type 18, shown in third area C.

Subliner elements of the second type 18, located in third area C, would preferably be made of a much more compliant material than that used for the subliner element of the third type 20, preferably at least five times more compliant and perhaps more than an order of magnitude more compliant than the stiffer materials recommended for subliner element of the third type 20. Such a material could be an extra soft polyurethane foam such as LAST-A-FOAM® EF-4003 by General Plastics Manufacturing Company, or EZ-Dri foam by Crest Foam Industries, both having, a relatively flat static and dynamic compression stress vs. deflection characteristic (the former 2.6 psi at 10%, 2.7 psi at 20%, 2.8 psi at 30%, 3.0 psi at 40%, and 3.4 psi at 50% and the latter 0.3 psi at 10%, 0.35 psi at 20%, 0.4 psi at 30%, 0.45 psi at 40% and 0.55 psi at 50%), so when incorporating the proper total area to accomplish the function of supporting the full weight or nearly the full weight of the helmet with the latter material enabling about five times the support area for extreme comfort, the exact location and thickness of the subliner elements of the second type 18 would not be that critical for the subliner elements of the second type 18 to be able to successfully support all, or almost all, of the weight of the helmet, yet contribute very little side force to the wearer's head 12 during an impact. However, the second type of subliner elements 18 are preferably positioned generally equidistantly about and between the first and third type of subliner elements 16, 20 in the third area C.

FIG. 1 schematically shows the cervical spine 13 and its seven cervical vertebrae labeled Atlas (C1), Axis (C2), C3, C4, C5, C6 and C7. For both centered (directed toward the center of gravity of a wearer's head) and non-centered impacts having a large horizontal force component, almost all the side forces (and torques) that would be imparted to a wearer's head 12 during an impact would be imparted through the subliner elements of the first type 16, which would be located, or substantially located, in first area A and generally evenly distributed/spaced thereabout. First area A places the point of application of these impact forces as close as possible to the head's two natural pivot points for angular acceleration: a lower pivot point 12*a* where the C7 cervical vertebrae (which can be located by the prominent bone at the base of the back of the neck) meets the T1 thoracic vertebrae, and an upper pivot point 12*b* where the C1 cervical vertebrae (the atlas bone) meets the paired occipital condyle projections of the skull to enable forward and backward rotation (a "yes" motion) of the head and where the atlas bone meets the C2 cervical vertebrae (the axis bone) enabling axial rotation (a "no" motion) and side-to-side rotation of the head, this latter pivot being located approximately just above and slightly in front of the ear lobes. Thus, all the head angular accelerating torques imparted to the user's head during an impact would be kept as small as possible for a given force as a result of this lowest practical positioning of subliner elements of the first type 16.

As stated previously, the subliner element of the third type 20, due to its flat horizontal lower surface 20*a*, typically does not impart a significant horizontal force to the wearer's head 12. Yet, there may be certain impacts during which the lower surface of the subliner element of the third type 20 would not remain flat but instead would tend to cup around the surface of the wearer's head 12. One such type of impact is obvious: a direct downward impact to the crown, or top, of the helmet 14, centered toward the center of gravity (c.g.) of the wearer's head 12. Although that type of impact would result in cupping the lower surface of subliner element of the third type 20 around the wearer's head 12, little or no horizontal force would be imparted to the wearer's head 12.

Another impact case that could cup the lower surface of the subliner element of the third type 20 might be a downward impact to the top of the helmet at a point located away from the crown and generally directed toward the body of the wearer. Picture a running back diving over the goal line, his helmet getting struck in midair by the shoulder pad of a linebacker diving the other way to stop him. Here, in addition to a significant downward force through the subliner element of the third type 20 (downward here meaning downward toward the body of the running back), there could be a not-insignificant horizontal force (horizontal here meaning horizontal relative to the body of the running back) imparted to the running back's head through subliner element of the third type 20, as well as through the subliner elements of the first type 16; for the most part the former would tend to rotate point b on the running back's head about the aforementioned upper pivot point toward the impact location, while the latter would tend to rotate point b about the aforementioned lower pivot point away from the impact location. So even in this case where the subliner element of the third type 20 cannot avoid imparting a horizontal (sideways) force, the structure of the total subliner system 10 still tends to cancel the above two rotational head motions and thereby reduce the resultant angular acceleration of the wearer's head 12.

Further reductions of imparted torque levels can be achieved by lowering the impact force levels, which can be accomplished by a proper choice of material for the subliner elements of the first type 16, and by including specific structural features in the subliner elements of the first type 16. Especially during an impact involving mostly a horizontal force component, only about one third of the subliner elements of the first type 16 (those located in the wide general region beneath the impact point) would be imparting most of the side normal force and side tangential force to the wearer's head 12 since the remaining subliner elements of the first type 16 would have tended to move away from the wearer's head 12 during the impact as the force-imparting subliner elements of the first type 16 compress and/or flex as a result of the high impact forces. The force levels could be of the same order of magnitude as those potentially experienced by the subliner element of the third type 20 (up to, and perhaps even more than a thousand pounds), and so the same energy absorbing viscoelastic foam materials cited for subliner element of the third type 20 would be in order for subliner elements of the first type 16, where their high energy absorption capability will help reduce the level of the high impact forces. The radial (thickness) dimension of the subliner elements of the first type 16 should be of sufficient length and have sufficient area to be able to avoid full densification at the maximum expected peak dynamic impact force, which could still be in the thousand-pound range for the total aggregate number of forces imparted on the subliner elements of the first type 16. On average the radial thickness of the subliner elements of the first type 16 would be approximately 0.25 to 1.25 inches, and preferably 0.75 inches.

In a preferred embodiment, to help further reduce the imparted tangential side forces, the subliner elements of the first type 16 may be partitioned into multiple segments which emanate in a substantially perpendicular direction from the inner surface 22 of the inner shell 24. The partitioning may be in the form of like-shaped segments having a particular cross-sectional shape, or it could be in the form of different shaped segments, as for instance an outer square cross-sectional shaped segment 36 having a centered circular cutout 38, along with a circular cross-sectional segment 40 to fill the circular cutout space, see FIG. 3. In order to best achieve the goal of reduced imparted side forces, the side surfaces of the partitioned side-by-side segments should be at least partially free to slide relative to each other in the segments' general radial direction. Each segment's generally parallel partitioned surfaces cannot be exactly radial from the standpoint of the wearer's head 12 due to the width of the partitioned element, but they are substantially radial. The partitioning or segmenting might be implemented using a simple "cookie cutter" approach. Other examples of partitioning subliner elements that could be used for the first type of subliner element 16 are described below in FIGS. 7*a*-7*b* through 15*a*-15*b*.

Figure 3:
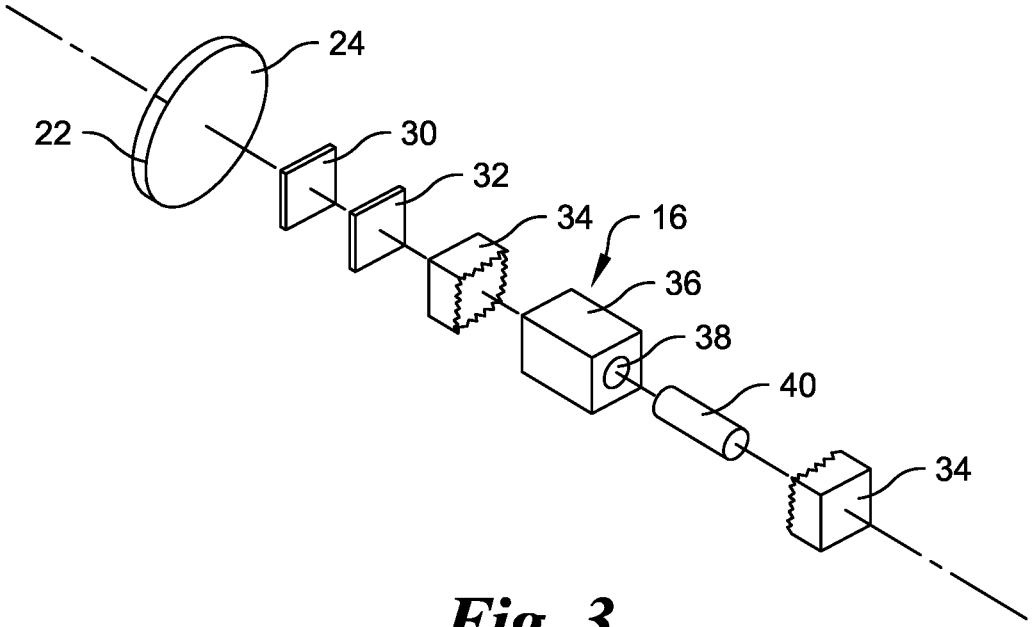
FIG. 3 is an exploded perspective view of a partitioned subliner element and its attachment to a portion of the inner shell, showing the portion of the inner shell, the hook part and the loop part of a hook and loop fastener mechanism, the partitioned segments, and an optional covering.

FIG. 3 is an exploded perspective view of a partitioned subliner element of the first type 16 and its attachment to a portion of the inner surface 22 of the inner shell 24, showing the portion of the inner shell 24, the hook part 30 and the loop part 32 of a hook and loop fastener mechanism of a type in common usage today for such applications, along with an optional covering 34 over the subliner element of the first type 16. Any of the subliner elements, of any of the three subliner element types 16, 18, 20 may include a full covering 34 formed from a fabric or a film 34 to improve the comfort of the wearer, to improve the durability of the subliner element types 16, 18, 20, or to improve the functioning of the subliner element types 16, 18, 20, the latter possibly including, but not being limited to, its ability hold partitioned columns of a subliner element type 16, 18, 20 in place, its ability to protect against moisture and contaminants, its ability to improve air flow, and its ability to improve moisture dissipation. The optional covering 34 need not be full as shown but may be partial if the circumstances warrant. The fabric of choice may be any of a wide range of suitable fabrics, while the film of choice could be any suitable polymer or elastomer film having a suitable thickness for the application.

FIG. 4 is a cross-sectional side view located at the midsagittal plane of the wearer's head 12 showing the three types of subliner elements 16, 18, 20 as located in FIG. 2 and the inner shell 24 to which they are attached. The inner shell 24 may be part of a single liner, single shell helmet 14 as illustrated in the figure, or it may be part of a multiple liner, multiple shell helmet, as discussed in more detail below. The relative size of the inner shell 24 shown in FIG. 4 at the lower end of the indicated radial thickness range would be consistent with the former case if the helmet were for example an equestrian helmet or a ski helmet, and the relative size of the inner shell shown in FIG. 4 would also be consistent with the latter case if the helmet were for example a football helmet or a motorcycle helmet. A football helmet or a motorcycle helmet of the single liner, single shell type would typically have a larger subliner system 10 at the higher end of the indicated radial thickness range, which in that case would also be the outer shell. Thus, in a football helmet or motorcycle helmet of the single liner, single shell type embodiment, the radial spacing of the inner shell 24 from the head 12 would typically be greater than that shown in FIG. 4 and the subliner elements of the first, second and third types 16, 18, 20 would accordingly have a greater radial dimension.

With continued reference to FIG. 4, the inner surface 22 of the inner shell 24 above subliner element of the third type 20 is shown to have a flat horizontal surface 42 rather than a concave surface. The inner shell 24 may be molded that way to achieve the flat horizontal surface 42. The flat horizontal surface 42 is not absolutely necessary but it is preferred to enable subliner element of the third type 20 to be flat on its upper surface as well as its lower surface 20*a*, which helps to assure a horizontal lower surface 20*a*, and makes it simpler and more controllable to determine, select, and properly align and apply a proper thickness subliner element of the third type 20 so that it's lower surface 20*a* remains horizontal and preferably barely touches the wearer's head 12. As shown in FIG. 4, the two cross-sectioned subliner elements of the second type 18 are shown in the third area C, properly radially compressed, as would be all of the other subliner elements of the second type 18 not shown in the cross-section, when all are supporting the full weight of the helmet, even though the full helmet with all its potential parts, including a potential face guard and a potential chin strap or jaw strap system, is not shown in FIG. 4. Finally, the subliner elements of the first type 16 in the first area A each have a thickness to yield a snug but not uncomfortable fit with the wearer's head 12.

Figure 5:
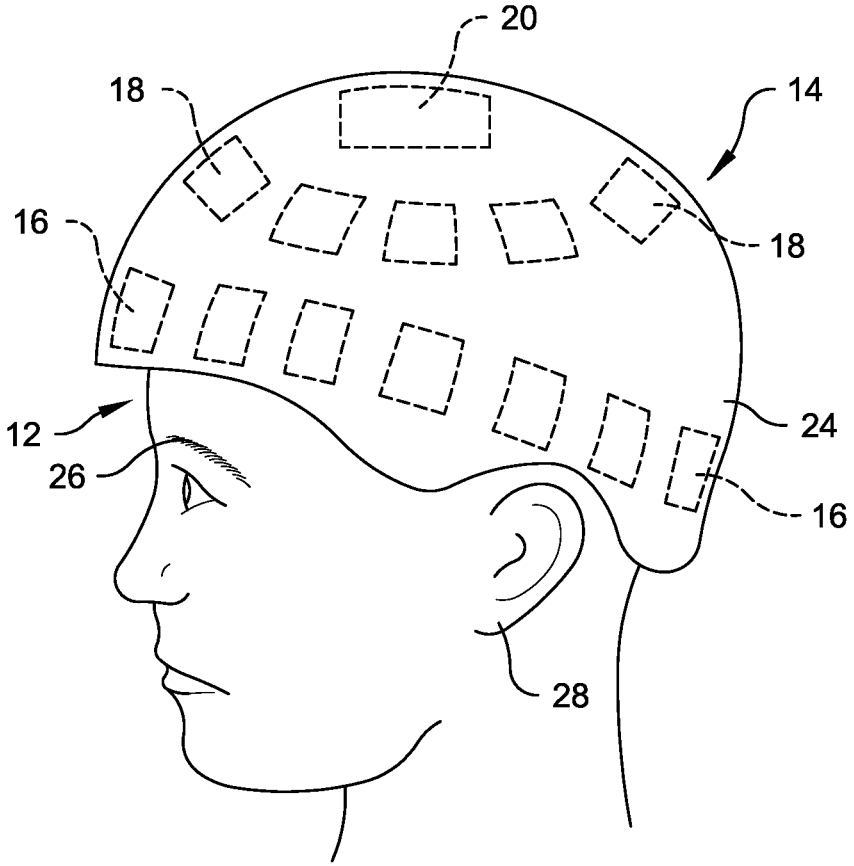
FIG. 5 is a left side elevational view showing the inner shell of FIG. 4 positioned on a wearer's head.

FIG. 5 is a left side elevational view of the wearer's head 12 showing the inner shell 24 of FIG. 4 located over the wearer's head 12 with all the subliner elements of the first, second and third type 16, 18, 20 positioned as shown in phantom and as in FIG. 2; all of the subliner elements of the first, second and third type 16, 18, 20 being attached to the inner surface 22 of the inner shell 24, typically by the easy-on, easy-off, hook and loop fastener mechanism 30, 32 shown in FIG. 3. The easy-on, easy-off capability helps in being able to customize the helmet for an individual wearer. The potential materials to be used for the inner shell 24 would depend upon which embodiment it is being used in. In the single liner, single shell helmet embodiment the inner shell 24 (which is now also the outer shell) must be able to handle a direct impact, so an impact resistant material such as polycarbonate or high impact ABS would be appropriate. In the multiple liner, multiple shell helmet embodiment described in more detail below, the inner shell 24 need not handle a direct impact, but it still would need to be able to handle high forces so a high strength polymer composite containing either glass fibers, carbon fibers, or Kevlar® fibers or a composite utilizing a combination of different fibers could be appropriate. Also, for this embodiment, the inner shell 24 could be constructed of a thin metal, such as stainless steel or an aluminum alloy (either perforated, or not perforated), and in large quantities could be fabricated by pressing it to shape in a die with a large machine press. Such a thin metal shell, perhaps a thirty-second of an inch or less in thickness, could weigh even less than a comparable polymer composite shell.

Figure 6:
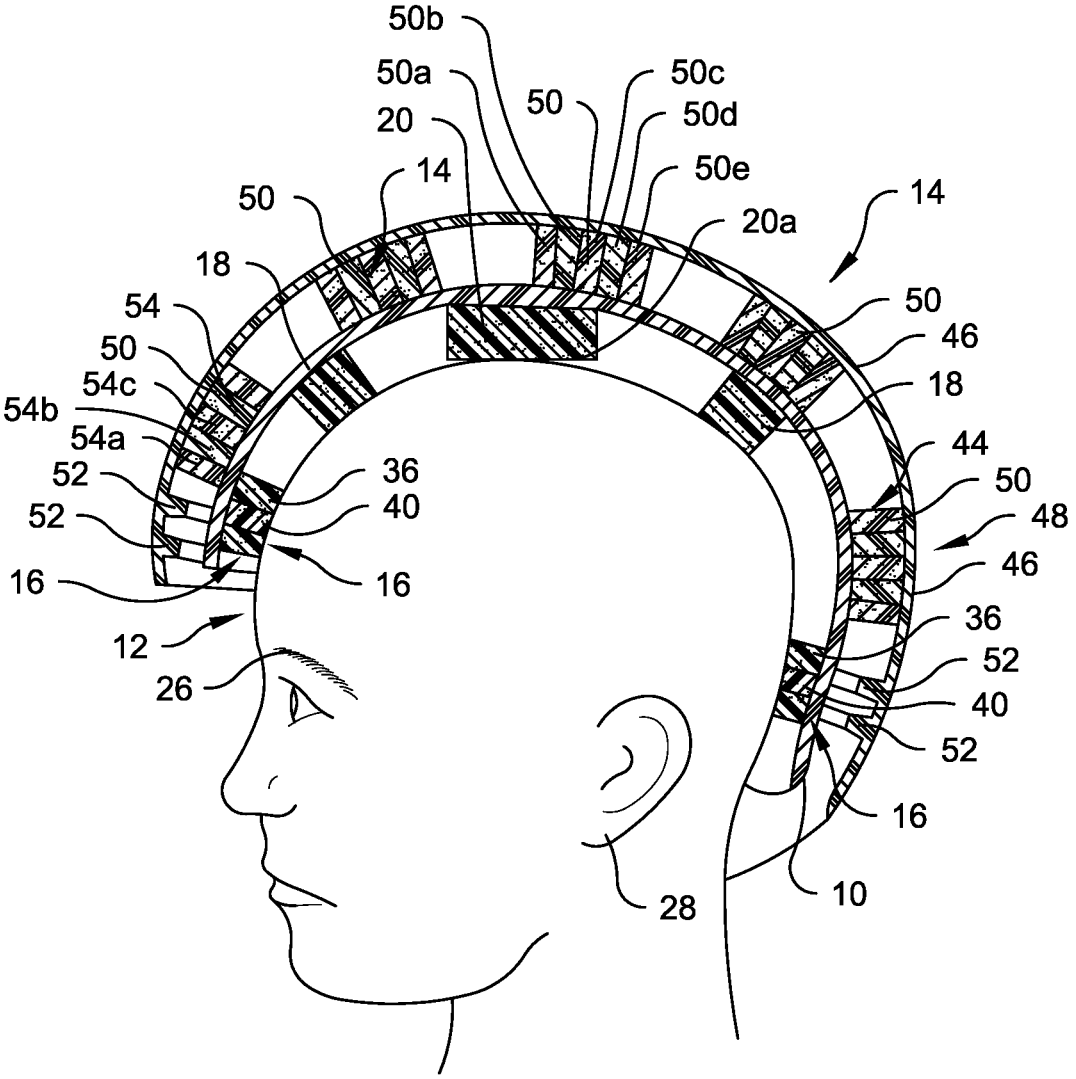
FIG. 6 is a cross-sectional side view at the midsagittal plane of a wearer's head, of a two liner, two shell helmet embodiment, where the subliner elements and the inner shell shown in FIG. 4 and FIG. 5 make up a subliner system, to which is added a second liner and an outer shell, the second liner being attached to both the inner shell and the outer shell in accordance with the present disclosure.

FIG. 6 is a cross-sectional side view located at the midsagittal plane of a wearer's head 12, showing a two liner, two shell, helmet 14 embodiment of the present disclosure. FIG. 6 shows the subliner system 10 of FIG. 4, plus a second or outer liner 44 and a second or outer shell 46 which together form an outer shell system 48. Five outer liner elements 50 are shown in the second liner 44 because they cross the midsagittal plane. Typically, there may be ten to fifteen additional liner elements 50 in the second liner 44 which are not shown in FIG. 6 because they do not cross the midsagittal plane. That would add up to a likely total of fifteen to twenty total liner elements 50 in the second liner 44, spread out more or less equidistantly throughout the available space between the inner shell 24 and the second or outer shell 46.

All the liner elements 50 of the second liner 44 are firmly attached to both the outer surface of the inner shell 24 and the inner surface of the outer shell 46. By contrast, subliner elements of the first, second and third types, 16, 18, 20 in the subliner system 10 can only be attached to the inner shell 24 (they cannot be attached to a wearer's head). The firm attachment of the liner elements 50 of the second liner 44 to both the inner and outer shells 24, 46 enables liner elements 50 to experience not just high compression forces, but high shear forces and high tensile forces as well. As a result, the attachment requirement here is beyond the capability of a standard hook and loop fastener and is more in the realm of a high strength, wide temperature range, flexible adhesive, such as LOCTITE® 4902™, or LOCTITE® Plastic Bonder, both by Henkel Corporation. The former is a one-part adhesive, the latter a two-part adhesive, and both are quick curing.

These flexible, high strength attachments make it possible for all the liner elements 50 of the second liner 44 to participate in mitigating any impact to the wearer's head 12, regardless of the impact's location or direction. That mitigation is accomplished through the widespread positioning of the liner elements 50 and their ability to efficiently absorb energy in three different modes: compression, shear, and tension. For example, for any centered impact the liner elements 50 of the second liner 44 generally located in the region beneath the impact will experience compression, those located to the side of the impact will experience shear, and those located opposite the impact will experience tension, while those located in between will experience some combination of compression, shear, and tension. For any non-centered impact most of the liner elements 50 of the second liner 44 will experience a higher degree of shear. Because every impact is different in its location and direction, each liner element 50 in the second liner 44 must be able to absorb energy at all the expected possible levels of compression, shear, and tension, and combinations thereof.

Furthermore, in order to even be in a position of optimally absorbing energy, each liner element 50 of the second liner 44 must become deformed during an impact to its full extent by the outer shell 46, not just those liner elements 50 beneath the impact, but those to the side of the impact, and those opposite the impact as well, and the outer shell 46 must remain rigid enough during the impact to be able to accomplish that. Because the outer shell 46 is relatively thin and typically made of a polycarbonate or high impact ABS, this requires that the outer shell 46 be rigidized, especially near its opening to accommodate a wearer's head 12, which is the place where it is the weakest. Notice in the figure, that there are two molded-in internal rings 52 near the opening to accomplish the rigidizing, but other rigidizing approaches such as severe contouring or metal banding (not shown) would also be acceptable.

Achieving the optimum energy absorption by all the liner elements 50 of the second liner 44 also requires they be fabricated of a material having an inherent high energy absorbing capability, and that the material also have a proper level of dynamic stiffness for the total second liner element 50 footprint area. To meet these criteria, the liner elements 50 of the second liner 44 may be fabricated from the same list of materials recommended for subliner elements of the first and third types 16, 20, the list including: a vinyl nitrile foam such as IMPAX® VN600, VN740, or VN1000 by Dertex Corporation, or a polyurethane foam such as LAST-A-FOAM® TF 8015 by General Plastics Manufacturing Company. However, in block form, each material likely presents too much dynamic stiffness in shear as compared to its dynamic stiffness in compression and tension. So to reduce a second liner element's dynamic stiffness in shear, without at the same time reducing its dynamic stiffness in compression or tension, partitioning of each liner element 50 into discrete adjacent segments is preferred, somewhat similar to what has been previously discussed for subliner elements of the first type 16, but even more so for the second liner elements 50 because the potential shear levels experienced by the second liner elements 50 are greater.

The cross-sectioning of the second liner elements 50 in FIG. 6 reveals each element to be partitioned into five equal segments 50*a*, 50*b*, 50*c*, 50*d*, 50*e*. However, one skilled in the art will understand that there are several partitioning possibilities, all of which could be acceptable options if they can achieve the proper level of reduction in the total shear force as compared to the total compression and tensile forces.

Figure 7A:
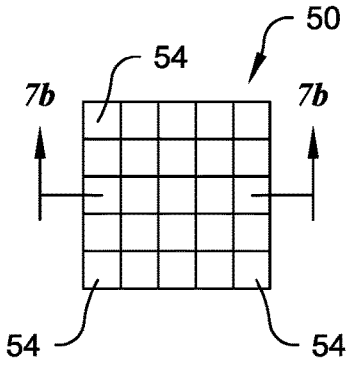
FIG. 7*a* illustrates, in top plan view, a first partitioning arrangement for the second liner elements of FIG. 6.
Figure 8A:
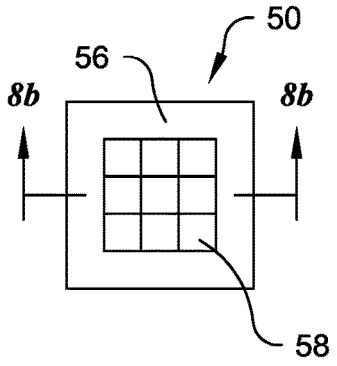
FIG. 8*a* illustrates, in top plan view, a second partitioning arrangement for the second liner elements of FIG. 6.
Figure 9A:
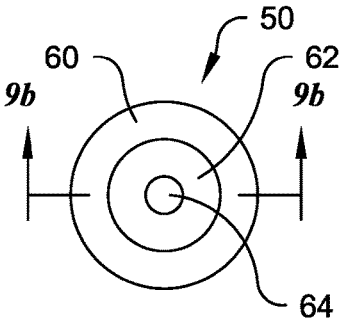
FIG. 9*a* illustrates, in top plan view, a third partitioning arrangement for the second liner elements of FIG. 6.
Figure 10A:
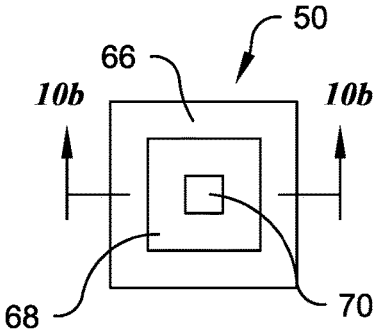
FIG. 10*a* illustrates, in top plan view, a fourth partitioning arrangement for the second liner elements of FIG. 6.
Figure 11A:
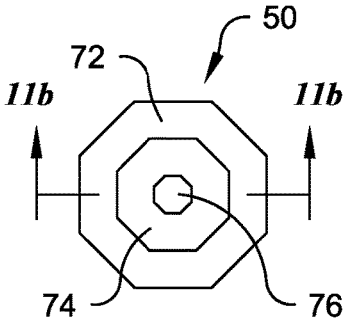
FIG. 11*a* illustrates, in top plan view, a fifth partitioning arrangement for the second liner elements of FIG. 6.
Figure 12A:
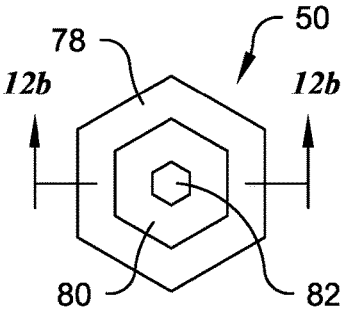
FIG. 12*a* illustrates, in top plan view, a sixth partitioning arrangement for the second liner elements of FIG. 6.
Figure 13A:
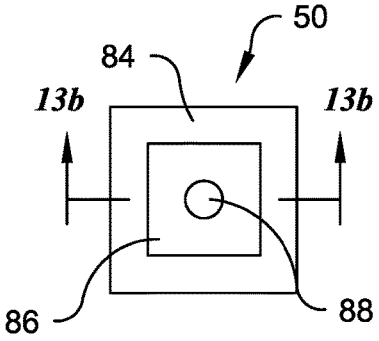
FIG. 13*a* illustrates, in top plan view, a seventh partitioning arrangement for the second liner elements of FIG. 6.
Figure 14A:
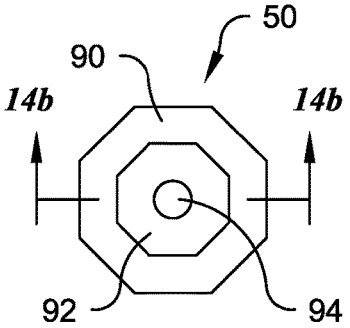
FIG. 14*a* illustrates, in top plan view, an eighth partitioning arrangement for the second liner elements of FIG. 6.
Figure 15A:
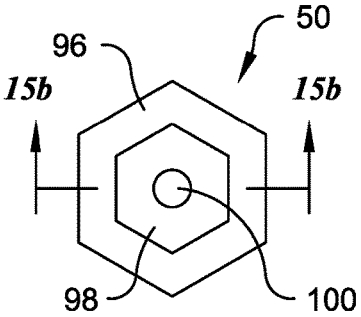
FIG. 15*a* illustrates, in top plan view, a ninth partitioning arrangement for the second liner elements of FIG. 6.

FIGS. 7*a* through 15*a* show nine such partitioning possibilities, illustrated in plain view (from the viewpoint of the outer shell 46) to be able to see what they actually could represent. Cross-sectional views in FIGS. 7*b* through 15*b* show the same sectional view as what is shown in FIG. 6. However, even these nine are still an extremely reduced sample of what may be possibly used as partitioning arrangements for the second liner elements 50. FIGS. 7*a* and 7*b* show twenty-five equal square shaped segments or foam columns 54 arranged in a 5×5 square array. That is, the foam columns 54 form a plurality of generally radially oriented side-by-side flexible individual and independent foam columns 54. The columns 54 are preferably formed entirely of foam and having a top surface 54*a*, a bottom surface 54*b*, and foam side surfaces 54*c* where the top surface 54*a* is directly attached to the inner surface of the outer shell 48 and the bottom surface is directly attached to the outer surface of the inner shell 24 and the foam side surfaces 54*c* of adjacent columns 54 are unattached and are situated side-by-side in slidable direct contacting frictional engagement. FIGS. 8*a* and 8*b* show a liner element 50 having an outer circumferential square wall 56 and an inner square cutout 58, filled with nine equal square shaped segments arranged in a 3×3 square array. FIGS. 9*a* and 9*b* show a liner element 50 having an outer annular wall 60, an inner annular wall 62 complementarily positioned in the outer annular wall 60 and an innermost cylinder 64 complementarily positioned within the inner annular wall 62. FIGS. 10*a* and 10*b* show a liner element 50 having a square outer annular wall 66, a square inner annular wall 68 complementarily positioned in the square outer annular wall 66 and an innermost generally square in cross section cylinder 70 complementarily positioned within the square inner annular wall 68. FIGS. 11*a* and 11*b* show a liner element 50 having octagonal outer annular wall 72, an octagonal inner annular wall 74 complementarily positioned in the octagonal outer annular wall 72 and an innermost generally octagonal in cross section cylinder 76 complementarily positioned within the octagonal inner annular wall 74. FIGS. 12*a* and 12*b* show a liner element 50 having a hexagonal outer annular wall 78, a hexagonal inner annular wall 80 complementarily positioned in the hexagonal outer annular wall 78 and an innermost generally hexagonal in cross section cylinder 82 complementarily positioned within the hexagonal inner annular wall 80. FIGS. 13*a* and 13*b* show a liner element 50 having square outer annular wall 84, a square inner annular wall 86 complementarily positioned in the square outer annular wall 84 and an innermost generally circular in cross section cylinder 88 complementarily positioned within the square inner annular wall 86. FIGS. 14*a* and 14*b* show a liner element 50 having octagonal outer annular wall 90, an octagonal inner annular wall 92 complementarily positioned in the octagonal outer annular wall 90 and an innermost generally circular in cross section cylinder 94 complementarily positioned within the octagonal inner annular wall 92. FIGS. 15*a* and 15*b* show a liner element 50 having a hexagonal outer annular wall 96, a hexagonal inner annular wall 98 complementarily positioned in the hexagonal outer annular wall 96 and an innermost generally circular in cross section cylinder 100 complementarily positioned within the hexagonal inner annular wall 98.

Figure 7B:
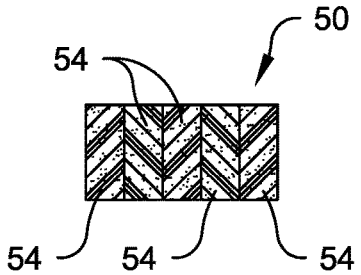
FIG. 7*b* is a cross-sectional view of FIG. 7*a* taken along line 7*b*-7*b*.
Figure 8B:
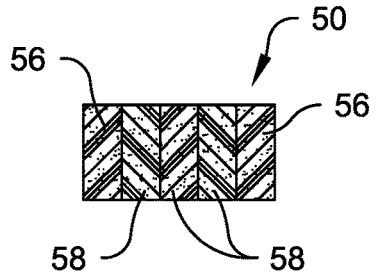
FIG. 8*b* is a cross-sectional view of FIG. 8*a* taken along line 8*b*-8*b*.
Figure 9B:
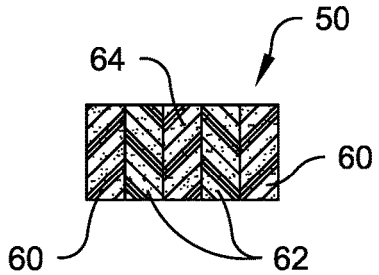
FIG. 9*b* is a cross-sectional view of FIG. 9*a* taken along line 9*b*-9*b*.
Figure 10B:
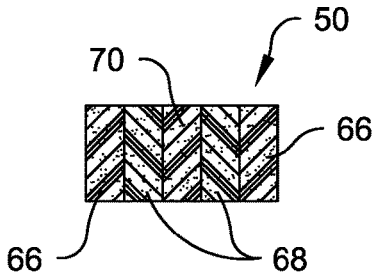
FIG. 10*b* is a cross-sectional view of FIG. 10*a* taken along line 10*b*-10*b*.
Figure 11B:
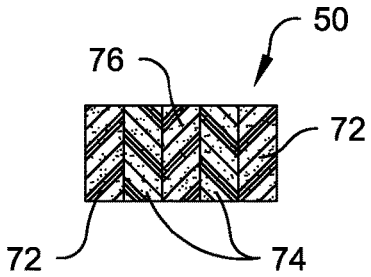
FIG. 11*b* is a cross-sectional view of FIG. 11*a* taken along line 11*b*-11*b*.
Figure 12B:
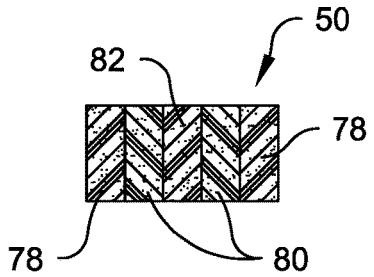
FIG. 12*b* is a cross-sectional view of FIG. 12*a* taken along line 12*b*-12*b*.
Figure 13B:
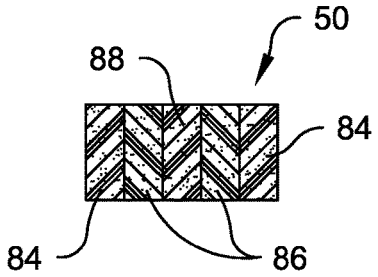
FIG. 13*b* is a cross-sectional view of FIG. 13*a* taken along line 13*b*-13*b*.
Figure 14B:
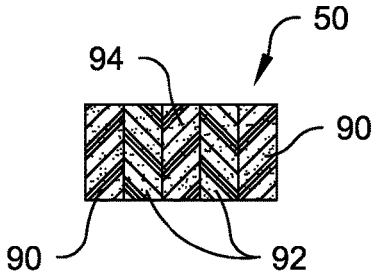
FIG. 14*b* is a cross-sectional view of FIG. 14*a* taken along line 14*b*-14*b*.
Figure 15B:
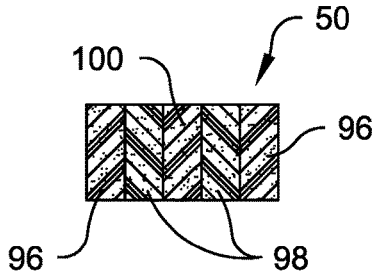
FIG. 15*b*. is a cross-sectional view of FIG. 15*a* taken along line 15*b*-15*b*.

FIGS. 7*a* and 7*b* show a specific case of the general class of a radially partitioned second liner element 50 into side-by-side segments. FIGS. 8*a* and 8*b* through FIGS. 15*a* and 15*b* show specific cases of the general class of radially partitioned second liner elements 50 into nesting and nested segments. Note that some segments can be both nesting and nested. Also note FIG. 3 shows an example of a nesting and nested segmented element, although not a second liner element 50 but a subliner element of the first type 16.

In general, the segment boundaries of the liner elements 50 (all formable by a "cookie cutter type slicer") would be oriented in a substantially radial direction (from the standpoint of the wearer's head 12, or the outer shell 46, etc.) but most can never be oriented exactly in the radial direction, in part due to the extended width dimensions of a liner elements 50. Nevertheless, for simplification purposes, this specification will still be referred to them as "radial." During an impact that results in a shearing motion of the liner elements 50, at least some of the adjacent segment surfaces may move relative to each other along their boundaries in the radial direction to form S curves (not shown), and through dynamic friction to thereby provide some additional energy absorption. The concept of absorbing energy through adjacent surfaces moving relative to each other to form S curves is fully described in U.S. Pat. No. 9,032,558, which is hereby incorporated by reference in its entirety. It is possible that too much static friction when all the motion has stopped would be problematic if the liner elements 50 do not fully return to their initial position following an impact. In practice, though, the static friction is not likely to be large enough to cause this problem. But whether it would become a problem or not, an inventive "solution" to the problem will be herein described which could add an additional, adjustable, energy absorption mechanism if it were needed.

The indicated solution is to thinly coat adjacent segment boundaries with a viscous material (not shown), especially near the center of the span between the inner and outer shells 24, 46 where the relative motion is the greatest. This not only would eliminate any residual static friction, it would, at the same time, provide additional dynamic friction, the degree of which could be controlled by altering the viscosity of the coating material used. High viscosity silicone fluids having various viscosities from under 100,000 cSt to over 1,000,000 cSt are available from Clearco Products. Furthermore, to assure that the coating material stays in place long term under the action of gravity and short term during impacts it is advisable to thoroughly mix in fumed silica to the silicone fluid, typically more than 5% by weight. Cab-O-Sil® TS-720 by Cabot Corporation would be suitable for this purpose. Note that FIGS. 6 and 7*a* through 15*b* would look the same regardless of whether or not the segment boundaries in the second liner elements 50 would be coated or not coated.

Figure 16:
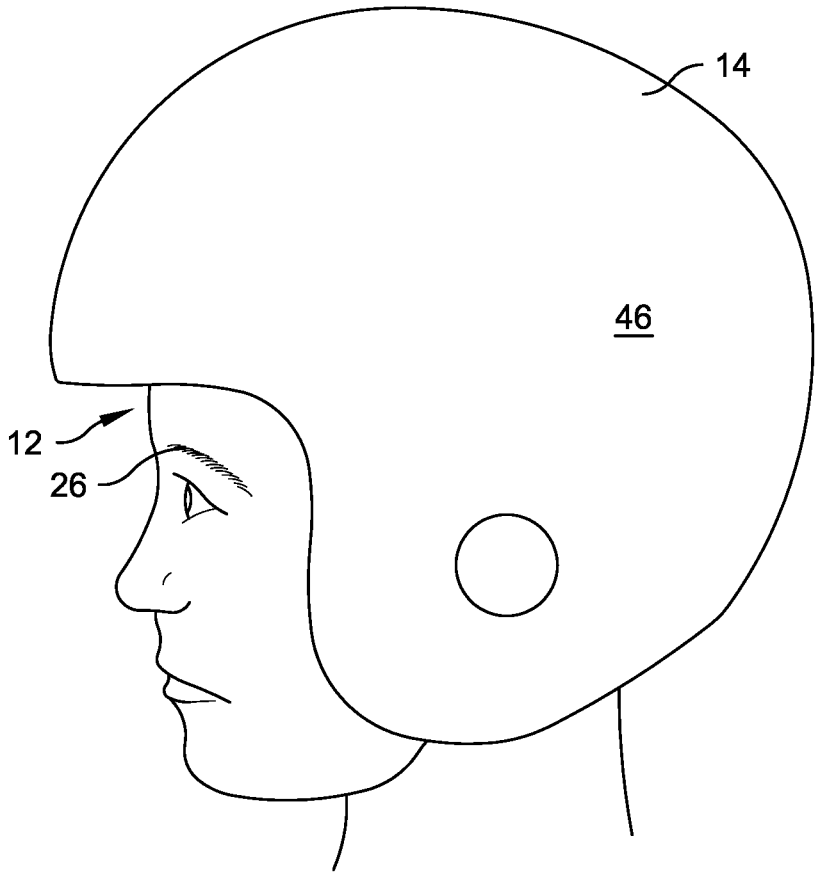
FIG. 16 is a left side elevational view showing the outer shell of FIG. 6 positioned on a wearer's head.

FIG. 16 illustrates a left side elevational view showing the outer shell 46 of FIG. 6 positioned on a wearer's head 12. The size and shape of the outer shell 46 might be typical of a football helmet.

Figure 17:
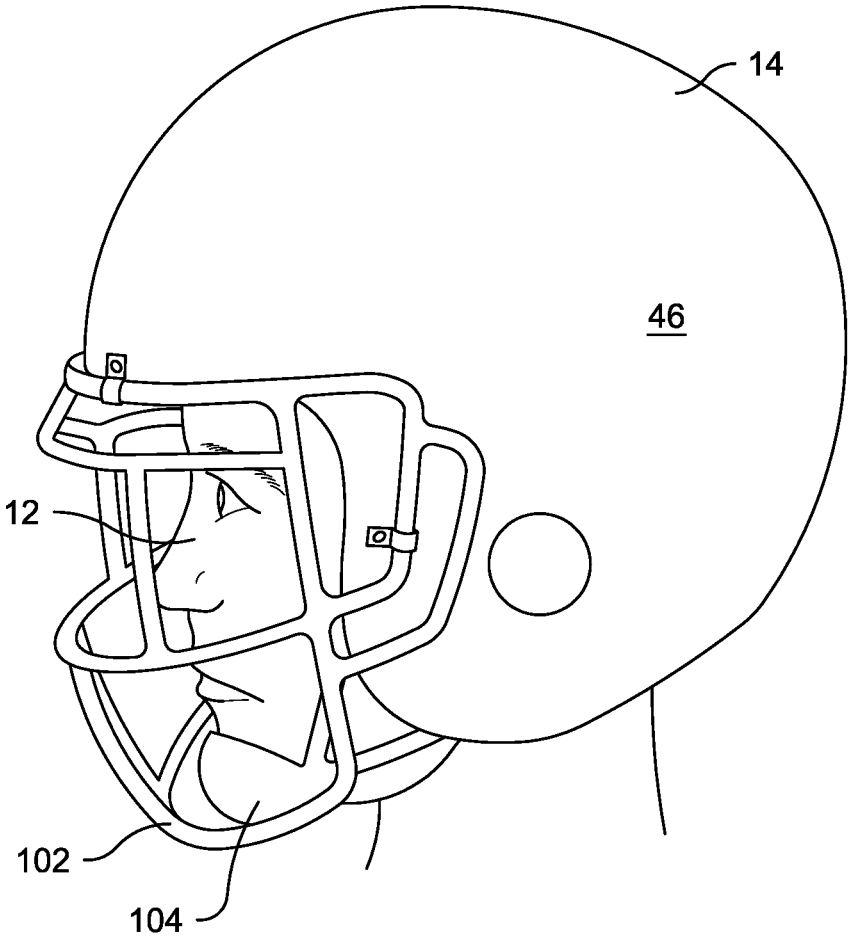
FIG. 17 is a left side elevational view of a wearer's head showing a face guard attached to the outer shell of FIG. 16, and a chin strap positioned on the wearer's chin and attached to the inner shell of FIG. 5.

FIG. 17 is a left side elevational view of a wearer's head 12 showing a face guard 102 attached to the outer shell 46 of FIG. 8, and a chin strap 104 positioned on the wearer's chin and attached to the inner shell 24 of FIG. 5, both typical of a football helmet application.

Finally, although only a first preferred embodiment having a subliner system 10, and a second preferred embodiment having a subliner system 10 and an outer shell system 48 have been described in significant detail, the addition of a third liner and a third shell (not shown) would still be within the scope of the present disclosure. It will also be appreciated by those skilled in the art that changes or modifications could be made to the above described embodiments without departing from the broad inventive concepts of the disclosure. Therefore, it should be appreciated that the present disclosure is not limited to the particular use or particular embodiments disclosed but is intended to cover all uses and all embodiments within the scope or spirit of the described disclosure.

I claim:

1. A helmet adapted to be worn on a head of a wearer, the head having a pair of eyebrows and a pair of ears, the head having an annular headband shaped area encircling the wearer's head, the headband shaped area being approximately 0.75 to 1.25 inches wide and having a lower edge defining a plane positioned approximately 0.5 to 1.5 inches above the eyebrows and approximately 0.25 to 0.75 inches above an upper junction of the ears and the wearer's head, a top area centered about a top of the wearer's head encompassing approximately 0.44 to 7 square inches, and a middle area of the head defined between the headband area and the top area, the helmet comprising:

a shell comprised of a hard impact resistant material, the shell having inner and outer surfaces, the shell adapted to surround at least a portion of the cranial part of wearer's head with the inner surface of the shell being spaced from the wearer's head at an initial pre-impact relative position when the helmet is worn; and a subliner, at least a part of which is adapted to be in contact with the wearer's head when the helmet is worn prior to an impact and during an impact, the subliner comprising:

a plurality of a first type of subliner elements extending from the inner surface of the shell at a location such that the first type of subliner elements are adapted to be aligned with the headband area when the helmet is worn, the first type of subliner elements being constructed of an energy absorbing viscoelastic foam material capable of exhibiting a compressive stress of at least 50 psi for a dynamic compression of 50%;

a plurality of a second type of subliner elements extending from the inner surface of the shell at a location such that the second type of subliner elements are adapted to be aligned with the middle area when the helmet is worn, the second type of subliner element being constructed of a foam material that can exhibit a compressive stress of less than 10 psi for a static and a dynamic compression of 50%; and a third type of subliner element extending from the inner surface of the shell at a location such that the third type of subliner element is adapted to be aligned with the top area when the helmet is worn, the third type of subliner element being comprised of an energy absorbing viscoelastic foam material capable of exhibiting a compressive stress of at least 50 psi for a dynamic compression of 50%, the third type of subliner element having a substantially flat lower surface which is substantially tangent to the surface of the wearer's head beneath it when the helmet is worn, the plurality of the second type of subliner elements being positioned between the plurality of the first type of subliner elements and the third type of subliner element.

2. The helmet as recited in claim 1, wherein the headband area is approximately 1 inch wide and the plurality of first type of subliner elements are adapted to be located to overlap the width of the headband area.

3. The helmet as recited in claim 1, wherein the top area is in the range of 0.44 to 7 square inches and the third type of subliner element is adapted to overlap the top area.

4. The helmet as recited in claim 1, wherein the plurality of first type of subliner elements are generally evenly spaced throughout a circumference of the headband area.

5. The helmet as recited in claim 1, wherein the second type of subliner elements are positioned between the first and third type of subliner elements in the middle area to at least partially support a weight of the helmet.

6. The helmet as recited in claim 1, wherein the first, second and third type of subliner elements are releasably secured to the inner surface of the inner shell using hook and loop material.

7. The helmet as recited in claim 1, wherein at least one of the first type of subliner elements is radially partitioned into individual and independent segments.

8. A helmet adapted to be worn on a head of a wearer, the head having a pair eyebrows and a pair of ears, the head having an annular headband shaped area encircling the wearer's head, the headband shaped area being approximately 0.75 to 1.25 inches wide and having a lower edge defining a plane positioned approximately 0.5 to 1.5 inches above the eyebrows and approximately 0.25 to 0.75 inches above an upper junction of the ears and the wearer's head, a top area is centered about a top of the wearer's head encompassing approximately 0.44 to 7 square inches, and a middle area of the head defined between the headband area and the top area, the helmet comprising:

an inner shell comprised of a hard material, the inner shell having inner and outer surfaces, the inner shell adapted to surround at least a portion of the cranial part of wearer's head with the inner surface of the inner shell being spaced from the wearer's head at an initial pre-impact relative position when the helmet is worn; and a subliner, at least a part of which is adapted to be in contact with the wearer's head when the helmet is worn prior to an impact and during an impact, the subliner comprising:

a plurality of a first type of subliner elements extending from the inner surface of the inner shell at a location such that the first type of subliner elements are adapted to be aligned with the headband area when the helmet is worn, the first type of subliner elements being constructed of an energy absorbing viscoelastic foam material capable of exhibiting a compressive stress of at least 50 psi for a dynamic compression of 50%;

a plurality of a second type of subliner elements extending from the inner surface of the inner shell at a location such that the second type of subliner elements are adapted to be aligned with the middle area when the helmet is worn, the second type of subliner elements being constructed of a foam material that can exhibit a compressive stress of less than 10 psi for a static and a dynamic compression of 50%; and a third type of subliner element extending from the inner surface of the inner shell at a location such that the third type of subliner element is adapted to be aligned with the top area when the helmet is worn, the third type of subliner element being comprised of an energy absorbing viscoelastic foam material capable of exhibiting a compressive stress of at least 50 psi for a dynamic compression of 50%, the third type of subliner element having a substantially flat lower surface which is substantially tangent to the surface of the wearer's head beneath it when the helmet is worn, the plurality of second type of subliner elements being positioned between the plurality of the first type of subliner elements and the third type of subliner element;

an outer shell comprised of a hard impact resistant material, the outer shell having inner and outer surfaces, the outer shell surrounding at least a portion of the inner shell, the inner surface of the outer shell being spaced from the outer surface of the inner shell at an initial pre-impact relative position; and a plurality of outer liner elements located in the space between the outer surface of the inner shell and the inner surface of the outer shell and attached to both the outer surface of the inner shell and the inner surface of the outer shell.

9. The helmet as recited in claim 8, wherein the headband area is approximately 1 inch wide and the plurality of first type of subliner elements are adapted to be located to overlap the width of the headband area.

10. The helmet as recited in claim 8, wherein the top area is in the range of 0.44 to 7 square inches and the third type of subliner element is adapted to overlap the top area.

11. The helmet as recited in claim 8, wherein the plurality of first type of subliner elements are generally evenly spaced throughout a circumference of the headband area.

12. The helmet as recited in claim 8, wherein the second type of subliner elements are positioned between the first and third type of subliner elements in the middle area to at least partially support a weight of the helmet.

13. The helmet as recited in claim 8, wherein the first, second and third type of subliner elements are releasably secured to the inner surface of the inner shell using hook and loop material.

14. The helmet as recited in claim 8, wherein at least one of the outer liner elements is comprised of an energy absorbing viscoelastic foam material capable of exhibiting a compressive strength of at least 50 psi for a dynamic compression of 50%.

15. The helmet as recited in claim 14, wherein at least one of the outer liner elements is radially partitioned into side-by-side independent segments.

16. The helmet as recited in claim 15, wherein the side-by-side independent segments are nested with respect to each other and whereby some of the nested segments have side surfaces in slidable direct contacting engagement.

17. The helmet as recited in claim 15, wherein the side-by side independent segments are columns whereby some of the columns have side surfaces in slidable direct contacting engagement.

18. The helmet as recited in claim 16, wherein a viscous coating exists on at least a portion of the side surfaces in slidable direct contacting engagement.

19. The helmet as recited in claim 17 wherein a viscous coating exists on at least a portion of the side surfaces in slidable direct contacting engagement.

* * * * *